US005635889A

United States Patent [19]

Stelter

[11] Patent Number: 5,635,889

[45] Date of Patent: Jun. 3, 1997

[54] DIPOLE PERMANENT MAGNET STRUCTURE

[75] Inventor: Richard E. Stelter, Livermore, Calif.

[73] Assignee: PERMAG Corporation, Fremont, Calif.

[21] Appl. No.: 532,385

[22] Filed: Sep. 21, 1995

[51] Int. Cl.[6] ..... H01F 7/02

[52] U.S. Cl. ..... 335/306

[58] Field of Search ..... 335/296–306

[56] References Cited

U.S. PATENT DOCUMENTS

| | | | |
|---|---|---|---|
| Re. 33,736 | 11/1991 | Clarke | 335/210 |
| 4,549,155 | 10/1985 | Halbach | 335/212 |
| 4,592,889 | 6/1986 | Leupold et al. | 419/66 |
| 4,647,887 | 3/1987 | Leupold | 335/211 |
| 4,654,618 | 3/1987 | Leupold | 335/304 |
| 4,692,732 | 9/1987 | Leupold et al. | 335/302 |
| 4,701,737 | 10/1987 | Leupold | 335/301 |
| 4,764,743 | 8/1988 | Leupold et al. | 335/306 |
| 4,810,986 | 3/1989 | Leupold | 335/301 |
| 4,831,351 | 5/1989 | Leupold et al. | 335/306 |
| 4,835,137 | 5/1989 | Leupold | 505/1 |
| 4,835,506 | 5/1989 | Leupold | 335/306 |
| 4,839,059 | 6/1989 | Leupold | 335/210 |
| 4,859,973 | 8/1989 | Leupold | 335/216 |
| 4,859,976 | 8/1989 | Leupold | 335/306 |
| 4,861,752 | 8/1989 | Leupold | 505/1 |
| 4,862,126 | 8/1989 | Leupold | 335/216 |
| 4,862,128 | 8/1989 | Leupold | 335/306 |
| 4,887,058 | 12/1989 | Leupold | 335/216 |
| 4,893,103 | 1/1990 | Leupold | 335/216 |
| 4,894,360 | 1/1990 | Leupold | 505/1 |

(List continued on next page.)

OTHER PUBLICATIONS

Table of Magnetic Materials, from CRC Handbook of Chemistry and Physics, CRC Press, Inc. 1993.

*Patents Available for Licensing*; U.S. Army Laboratory Command Electronics Technology and Devices Laboratory.

Herbert A. Leupold and Ernest Potenziani II; *An Overview of Modern Permanent Magnet Design*; Research and Development Technical Report SLCET–TR–90–6; Aug. 1990.

Klaus Halbach; *Permanent Magnets for Production and Use of High Energy Particle Beams*; Center for X–Ray Optics, Lawrence Berkeley Laboratory, 6–8 May, 1985.

Rollin J. Parker; *Advances in Permanent Magnetism*; John Wiley & Sons; Copyright 1990.

Lester R. Moskowitz; Permanent Design and Application Handbook; Cahners Books International, Inc.; Copyright 1976.

*Primary Examiner*—Michael L. Gellner

*Assistant Examiner*—Raymond M. Barrera

*Attorney, Agent, or Firm*—Blakely, Sokoloff, Taylor & Zafman LLP

[57] ABSTRACT

A dipole permanent magnet structure having a rectangular gap about a longitudinal axis, in which tapered pole pieces form opposing sides of the rectangular gap to permit establishing a magnetic field in the gap. Permanent magnets having a rectangular shape are coupled to the rear, or base, of each pole piece, and have a magnetic field oriented in the same direction as the pole pieces, perpendicular to longitudinal axis, thereby establishing a magnetic field between the pole pieces. Additional permanent magnets, including a pair of blocking magnets, are coupled to the aforementioned permanent magnets to form a magnetic circuit. The orientation of the magnetic field of each permanent magnet is generally aligned in the direction of the lines of flux in the magnetic circuit to maximize the flux density within the air gap created by formation of the permanent magnets. Moreover, the pair of blocking magnets each form an opposing side of the rectangular gap adjacent to the pole pieces to prevent fringing. The structure is thus capable of generating a magnetic field having a flux density greater than the residual flux density of the magnet material. Indeed, the gap flux density is limited only by the saturation flux density of the pole pieces. Thus, the permanent magnets can be made of magnet material having high coercivity and high saturation magnetization level. An embodiment of the magnet structure is capable of generating a magnetic field in the air gap having a flux density of 2.2 Tesla (22,000 Gauss).

40 Claims, 11 Drawing Sheets

U.S. PATENT DOCUMENTS

| | | | |
|---|---|---|---|
| 4,911,627 | 3/1990 | Leupold | 425/3 |
| 4,917,736 | 4/1990 | Leupold | 148/108 |
| 4,928,081 | 5/1990 | Leupold | 335/216 |
| 4,953,555 | 9/1990 | Leupold et al. | 128/653 A |
| 4,994,777 | 2/1991 | Leupold et al. | 335/302 |
| 4,994,778 | 2/1991 | Leupold | 335/306 |
| 5,014,028 | 5/1991 | Leupold | 335/210 |
| 5,028,902 | 7/1991 | Leupold et al. | 335/306 |
| 5,034,715 | 7/1991 | Leupold et al. | 335/306 |
| 5,041,419 | 8/1991 | Leupold | 505/1 |
| 5,055,812 | 10/1991 | Abele et al. | 335/210 |
| 5,063,004 | 11/1991 | Leupold | 264/22 |
| 5,072,204 | 12/1991 | Leupold | 335/306 |
| 5,075,662 | 12/1991 | Leupold et al. | 335/306 |
| 5,162,771 | 11/1992 | Abele | 335/306 |

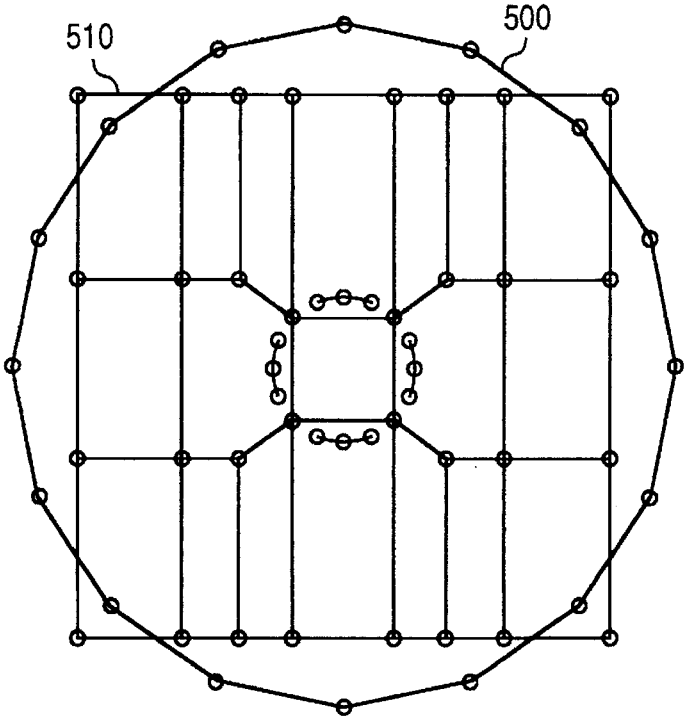
FIG. 5C
FIG. 5D
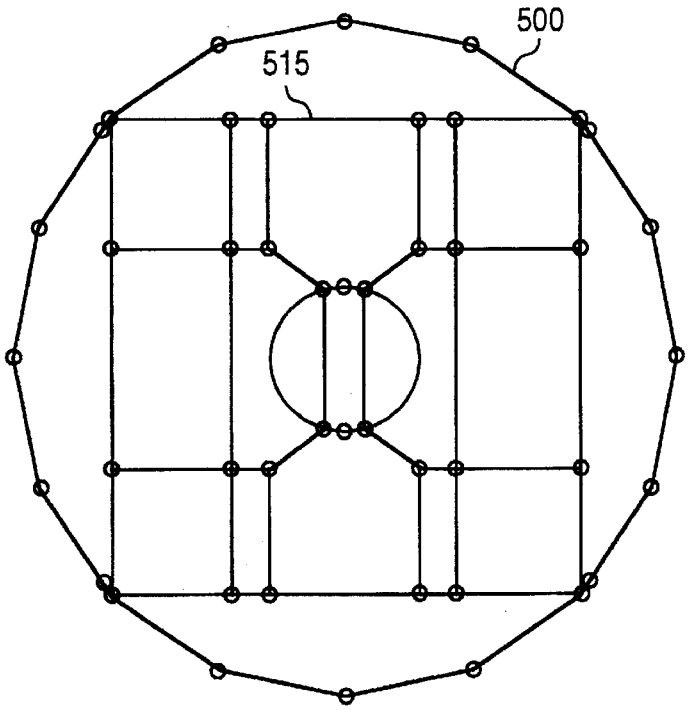

DIPOLE PERMANENT MAGNET STRUCTURE

BACKGROUND OF THE INVENTION

1. Field of the Invention

The present invention relates to the field of permanent magnets. More specifically, the present invention relates to the field of multipole or dipole permanent magnet (PM) structures for generating an intense magnetic field in a gap using a minimal volume of magnet material for the permanent magnet structure.

2. Description of the Related Art

Introduction

The present invention relates to a configuration of a plurality of permanent magnets to produce a permanent magnet (PM) structure capable of generating a magnetic field in an aperture or gap formed by the permanent magnets having a high flux density.

The performance of a permanent magnet depends on the magnet itself and the environment in which it operates. Advances in permanent magnetism have had a large impact on the number of applications for which permanent magnets may now be used or considered. Advances in such areas as magnet material (for example, rare earth magnet materials), magnet size, and magnet structure have combined to produce permanent magnets having internal magnetic fields with very high flux densities, for example, above 1.4 Tesla (14,000 Gauss). Indeed, today the properties exhibited by permanent magnets offer compelling reasons to use permanent magnets over electromagnets.

Electromagnets can produce quite large magnetic fields by driving electrical current through a coil of electrically conductive wire. However, the size and expense of such electromagnets, as well as power supply requirements and heat dissipation problems, make electromagnets unattractive for applications requiring an intense magnetic field in a physically small space.

Permanent magnets are used in applications that exploit the permanent magnet's unique capability to provide a force, or perform work of some kind without contact. In order for a permanent magnet to perform work, it must generate a magnetic field external to itself. Typically, the object upon which the permanent magnet operates is placed or passes through an aperture or air gap, or simply, gap, in the magnetic circuit formed by the permanent magnetic structure. The greater the strength of the magnetic field capable of being generated by the permanent magnet structure in the gap, the greater the permanent magnet's ability to perform work. To that end, research has focused on techniques to improve the efficiency of the magnetic circuit formed by the permanent magnet structure so as to maximize the strength of the magnetic field in the gap while minimizing the volume of magnet material required.

There are many prior art permanent magnet structures, from the ubiquitous (:;-shaped dipole permanent magnet to complex multipole permanent magnet structures designed for highly specific applications, for example, synchrotron radiation, or the operation of free electron lasers. Yet some applications, such as spectrometers based on exploiting the Zeeman effect, or the field of power generation known as magnetohydrodynamics, require magnetic field intensities unattainable within the design limitations imposed by such applications using the permanent magnet structures available heretofore due to, inter alia, leakage flux and fringing flux, as briefly described below.

Leakage and Fringing Flux

A brief overview of prior art permanent magnet structures and their limitations with respect to leakage flux and fringing flux is beneficial for understanding the present invention.

An efficient design of a permanent magnet should minimize the effects of leakage flux and fringing flux. Minimizing leakage flux and fringing flux can be accomplished by recognizing and accommodating in the design of the permanent magnet structure the following principles:

1. Magnetic lines of force (flux lines) follow the path of least reluctance (the reciprocal of permeance). Thus, for example, flux lines will generally flow more easily through ferromagnetic materials than air because ferromagnetic materials have a higher permeance than air.

2. Flux lines flowing in the same direction repel one another. Thus, magnetic lines of force tend to diverge as they move away from a pole rather than converge or remain parallel.

3. Flux lines always form closed loops and cannot, therefore, intersect.

4. Flux lines represent a tension along their length which tends to make them as short as possible. Thus, given that flux lines also form closed loops, they always form curved lines from the nearest north pole to the nearest south pole in a path that forms a complete closed loop. (Flux lines do not necessarily go from the north pole to the south pole of the same magnet, but may go from the north pole of one magnet to the south pole of another magnet that is either physically closer to the north pole or there is a path to the south pole of the other magnet having a lower reluctance than the path to the south pole of the same magnet).

5. In a magnetic circuit, any two points of equal distance from a neutral axis function as poles, wherein flux lines exist between them.

Keeping the above principles in mind, and with reference to FIG. 1, a permanent magnet structure 100 is illustrated in which permeable pole pieces 102 and 103 (which may be made of, for example, mild steel), permanent magnet 101, and air gap 104 form a magnetic circuit. Fringing flux is flux near air gap 104 that passes around the air gap as flux lines 105, primarily because of principles (1) and (2) above rather than directly through the air gap as flux lines 107. Leakage flux is flux lines 106 flowing between pole pieces 102 and 103 and across the back of the magnetic circuit from the north pole to the south pole of magnet 101, primarily because of principles (1), (4) and (5).

As illustrated in FIG. 1, the total flux directly through the air gap is less than the total flux in the magnetic circuit formed by permanent magnet structure 100 because of the effects of fringing flux and leakage flux. The magnetic field intensity (H) present in air gap 104 is directly related to the number of lines of flux, i.e., the flux density (B), within air gap 104, based on the equation:

$$H=\mu B$$

where μ is the permeability of, in this case, air (a constant). Thus, the greater the number of lines of flux passing directly through the air gap, i.e., the greater the flux density (B) in the air gap, the greater the magnetic field intensity (H) in the air gap.

Techniques that minimize fringing flux and leakage flux can improve the efficiency of the magnetic circuit formed by a permanent magnet structure by increasing the magnetic field intensity (H) in the air gap where it is desired in order to perform work. FIGS. 2(*a*), (*b*), (*c*), and (*d*) illustrate four methods of minimizing leakage flux. FIG. 2(*a*) illustrates optimizing the shape of the permanent magnet. Magnet 201 is optimized to minimize leakage flux occurring in magnet 200. FIG. 2(*b*) illustrates optimizing the location of permanent magnets within a magnetic circuit. While magnet 211 is an improvement over magnet 210, magnet 212 is the best configuration for reducing leakage flux. FIG. 2(*c*) demonstrates using blocking poles or blocking magnets to reduce leakage flux in the area in which the blocking pole is placed. The use of blocking poles is based on the principle that flux lines from like poles repel each other. Thus, leakage that may occur across the inside area of horseshoe magnet 220 is minimized by inserting a bar magnet 221 (having, importantly, the same magnetic field orientation as magnet 220, thereby providing a counter magnetomotive force) in the inside area of magnet 220. The same principle applies to the placement of blocking magnets 223 and 224 about bar magnet 222—the presence of properly oriented permanent magnets at the appropriate position in the magnetic circuit reduce leakage flux and, as a result, increase flux density in the air gap. Finally, FIG. 2(*d*) illustrates optimizing the magnetic field orientation, i.e., aligning the magnetic lines of force with respect to the physical dimensions of the permanent magnet 231 to achieve a more efficient magnetic circuit than in the case of magnet 230.

Notwithstanding the above methods for reducing leakage flux and fringing flux, the flux density of the external magnetic field in the air gap is still limited by the leakage of flux to some fraction of the intrinsic flux density of the magnet material used. To increase the flux density in the gap, it is well known to those of skill in the relevant art to collect and concentrate the available flux in the circuit by using permeable pole pieces, which may be tapered in the direction of the air gap. Generally, the permeance of an air gap is directly proportional to the area of the gap and inversely proportional to the length of the gap. Increasing the air gap area or, more preferably, reducing the length of the gap will increase the permeance of the gap. The tapering of the pole pieces, in contrast, increases the length of the path along the edge of the gap, where the fringing flux passes.

Tapering the pole pieces decreases the permeance at the edge of the air gap and, as a result, decreases the fringing flux. However, this increases the magnetic potential at the pole piece edges, and much of the available flux is lost to intramagnet leakage, as illustrated in FIG. 3. In FIG. 3, a prior art H-shaped dipole permanent magnet structure 300 is comprised of a yoke 301 made of, for example, a permeable steel alloy, and two permanent magnets 302 and 303. To each of the permanent magnets is coupled a tapered pole piece 304 and 305, respectively, made of high permeability alloy. Air gap 308, through which flux lines 307 directly pass, completes the magnetic circuit. Because the pole pieces are made of high permeability alloy, and due to the reluctance of the air gap, the flux density along the beveled sides of the pole pieces increases. For example, the increase in flux density along a beveled side of pole piece 304 increases the magnetic potential across the magnet 302 and causes flux to leak back over the surface of magnet 302, as illustrated by flux lines 306. Thus, it can be seen that tapered pole pieces may not provide as much of an increase in gap flux density as desired due to intramagnet leakage.

With reference to FIG. 4, a prior art H-type dipole permanent magnet structure 400 improves upon the structure of FIG. 3 by placing blocking magnets (403, 404, 405 and 406) between pole pieces (407, 408, 409 and 410) and the yoke 401. In so doing, flux from the blocking magnets prevents leakage from the pole pieces back to the permanent magnets (402 and 403), or from the pole pieces to the yoke, thereby contributing to the total flux available (flux lines 412) at the gap 411. Leakage due to fringing flux is not entirely prevented due to the open areas to the side of air gap 411 into which the magnetic field in the air gap expands, reducing flux density in the air gap.

Although the flux density (B) of the external magnetic field in the air gap of the permanent magnet structure in FIGS. 3 and 4 is greater than the flux density in the air gap of the structures illustrated in FIGS. 2(*a*), (*b*), (*c*), and (*d*), B is still limited by the leakage of flux to some fraction of the intrinsic flux density of the magnet material used. The prior art permanent magnet structure of FIG. 5(*a*) further increases the flux density in an air gap through the superposition of the magnetic fields of each of the trapezoidal-shaped permanent magnet segments.

With reference to FIG. 5(*a*), a cross sectional view of a prior art dipole permanent magnet structure is illustrated. A plurality of trapezoidal shaped permanent magnet segments 502 are arranged perpendicular to a longitudinal axis within a cylindrical yoke 501, forming a cylindrical air gap 503 along the center of the axis. The orientation of the magnetic field 504 of each segment 502 is aligned with respect to the magnetic field of an adjacent segment to complete a magnetic circuit through the segments, thereby forming a uniform dipole magnetic field 505 in air gap 503 perpendicular to the longitudinal axis. FIG. 5(*b*) illustrates the effect of superpositioning the magnetic field 504 of each segment 502.

The prior art permanent magnet structure in FIG. 5(*a*) provides a very uniform magnetic field in the central two-thirds (⅔) of the interior diameter of air gap 503. However, a gap flux density greater than the residual flux density ($B_r$) of the magnet segments 502 may cause the inside corners of the segments to be exposed to a magnetic field whose intensity is greater than the intrinsic coercivity of the magnet material used in the segments. Such exposure can reverse the direction of magnetization in the corners of the segments, limiting the maximum flux density of the air gap. Furthermore, unlike the prior permanent magnet structures shown in FIGS. 3 and 4, ferrous material cannot be used in the permanent magnet structure of FIG. 5(*a*). Coupling permeable pole pieces to segments 502 in gap 503 would cause flux to be shunted around the air gap rather than through it, lowering the flux density of the gap rather than increasing it. Thus, the maximum flux density of the air gap is proportional to the residual flux density of the magnet material used in the segments times the natural log of $R_o/R_i$, and factors for the number of segments used and the axial length of the structure, where $R_o$ is the outside radius of the structure and $R_i$ is the inside radius of the structure.

Yet another limitation of the prior art permanent magnet structure shown in FIG. 5(*a*) is that the geometry is not well suited to applications requiring a rectangular aperture.

It is evident from the above discussion that an external magnetic field in a rectangular or square gap having a very high flux density or a flux density greater than the residual flux density ($B_r$) of the magnet material employed generally cannot be produced economically with prior art dipole permanent magnet structures. What is needed is a dipole permanent magnet structure that can achieve high magnetic field intensities, for example, having a flux density above 2 Tesla (20,000 Gauss)

OBJECTS OF THE INVENTION

Thus, the foregoing discussion highlights that high flux density magnetic fields (greater than the residual flux density ($B_r$) of the magnet material employed) generally cannot be produced economically with prior art dipole permanent magnet structures. What is needed is a dipole permanent magnet structure that can achieve high magnetic field intensities in a rectangular or square air gap having a flux density above 2 Tesla (20,000 Gauss).

Moreover, it can be seen that it is desirable to increase the efficiency of a permanent magnet structure by maximizing the strength of the magnetic field in the gap of the PM structure while minimizing volume of the magnet material required to generate the external field.

To that end, it is an object of the present invention to provide a dipole permanent magnet structure capable of generating a magnetic field greater than 2.2 Tesla (22,000 Gauss) in an air gap.

It is a further object of the present invention to achieve a very high external magnetic field while minimizing the volume of magnet material required for the permanent magnet structure.

It is yet another object of the invention to provide a dipole magnet structure capable of generating an external magnetic field in an air gap whose flux density is greater than the residual flux density of the magnet material employed in the dipole magnetic structure.

Another object of the present invention is to provide a permanent magnet structure having a air gap suitable for certain applications requiring a rectangular or square aperture.

A further object of the invention is to minimize the number of permanent magnet blocks or segments required to form a dipole permanent magnet structure capable of generating an intense magnetic field in an aperture formed by the configuration of the individual permanent magnets.

An additional object of the present invention is to provide a permanent magnet structure that increases the flux density of the external magnetic field in the air gap beyond prior art limitations so that the flux density of the air gap is limited by the saturation flux density of the permeable material used in the pole pieces rather that the residual flux density of the magnet material used in the permanent magnets.

SUMMARY OF THE DISCLOSURE

The present invention relates to a configuration of a plurality of permanent magnets for producing a permanent magnet (PM) structure capable of generating a very high flux density magnetic field in an aperture or gap formed by the permanent magnets, while minimizing the required volume of magnet material.

An embodiment of the present invention provides a dipole permanent magnet structure that employs superpositioning of the magnetic fields of each of the permanent magnets therein to create a magnetic field in a rectangular air gap that has a flux density greater than the residual flux density of the magnet material employed in the permanent magnets. The configuration of permanent magnets drive tapered pole pieces progressively into saturation. Blocking magnets are sized and shaped so they contribute flux lines to the superimposed magnetic field and form a blocking field to prevent fringing flux around the gap. The structure provides a magnetic field with the highest possible gap flux density for a given amount of highly coercive permanent magnet material. The permanent magnets may be comprised of rare earth magnet material such as Samarium Cobalt or Neodymium Iron Boron. Pole pieces may be comprised of permeable material such as low carbon steel or Hiperco 50 depending on the gap flux density desired.

BRIEF DESCRIPTION OF THE DRAWINGS

The embodiments of the present invention are illustrated by way of example and not limitation in the accompanying figures, in which:

FIG. 2(*b*) illustrates another method for minimizing the effects of fringing flux and leakage flux in permanent magnet structures.

FIG. 2(*c*) illustrates a further method for minimizing the effects of fringing flux and leakage flux in permanent magnet structures.

FIG. 2(*d*) illustrates yet another method for minimizing the effects of fringing flux and leakage flux in permanent magnet structures.

FIG. 5(*b*) illustrates the orientation of the magnetic lines of force of the permanent magnet structure in FIG. 5(*a*).

FIG. 5(*c*) illustrates the overlay of geometries of a prior art dipole permanent magnet structure and a structure embodying the present invention.

FIG. 5(*d*) illustrates the overlay of geometries of a prior art dipole permanent magnet structure and a structure embodying the present invention.

FIG. 7(*b*) illustrates the orientation of the magnetic lines of force of the structure in FIG. 7(*a*).

DETAILED DESCRIPTION OF THE EMBODIMENTS OF THE INVENTION

In the following description, numerous specific details are set forth in order to provide a thorough understanding of the present invention. It will be apparent, however, to one of ordinary skill in the art that the present invention may be practiced without these specific details. In other instances, well-known structures, materials, and techniques have not been shown in order not to unnecessarily obscure the present invention. The present invention relates to a configuration of a plurality of permanent magnets for producing a dipole permanent magnet (PM) structure capable of generating an external magnetic field in an aperture or gap formed by the permanent magnets while minimizing the total volume of magnet material in the structure. The permanent magnet structure is capable of generating a magnetic field having a very high flux density in the gap—2.2 Tesla (22,000 Gauss).

In one embodiment of the present invention, a dipole PM structure combines principles of 1) superpositioning of the magnetic fields of adjacent permanent magnets to complete through the varying alignment of the magnetic fields a magnetic circuit through the PM structure with 2) the use of tapered permeable pole pieces made of, for example, 2V-Permendur or Hiperco 50 to produce a very high flux density in an aperture, or air gap, formed by the configuration of the individual permanent magnets and pole pieces.

The combination of superpositioning the magnetic fields of the permanent magnets and using pole pieces allows for the use of permanent magnets comprised of magnet material having the highest possible residual flux density without regard for the intrinsic coercivity ($H_{ci}$) of the magnet material. Indeed, the flux density in the air gap of an embodiment of the present invention is to some extent limited by the saturation flux density of the pole pieces—approximately 2.4 Tesla (24,000 Gauss). By contrast, prior art dipole permanent magnet structures are limited by the residual flux density of the permanent magnet material. A very high residual flux density is approximately 1.4 Tesla (14,000 Gauss). Thus, an embodiment of the present invention is able to produce an external magnetic field in an air gap of a permanent magnet structure in which the flux density in the air gap is 10,000 Gauss greater than the flux density in the air gap of prior art dipole permanent magnet structures.

Figure 1:
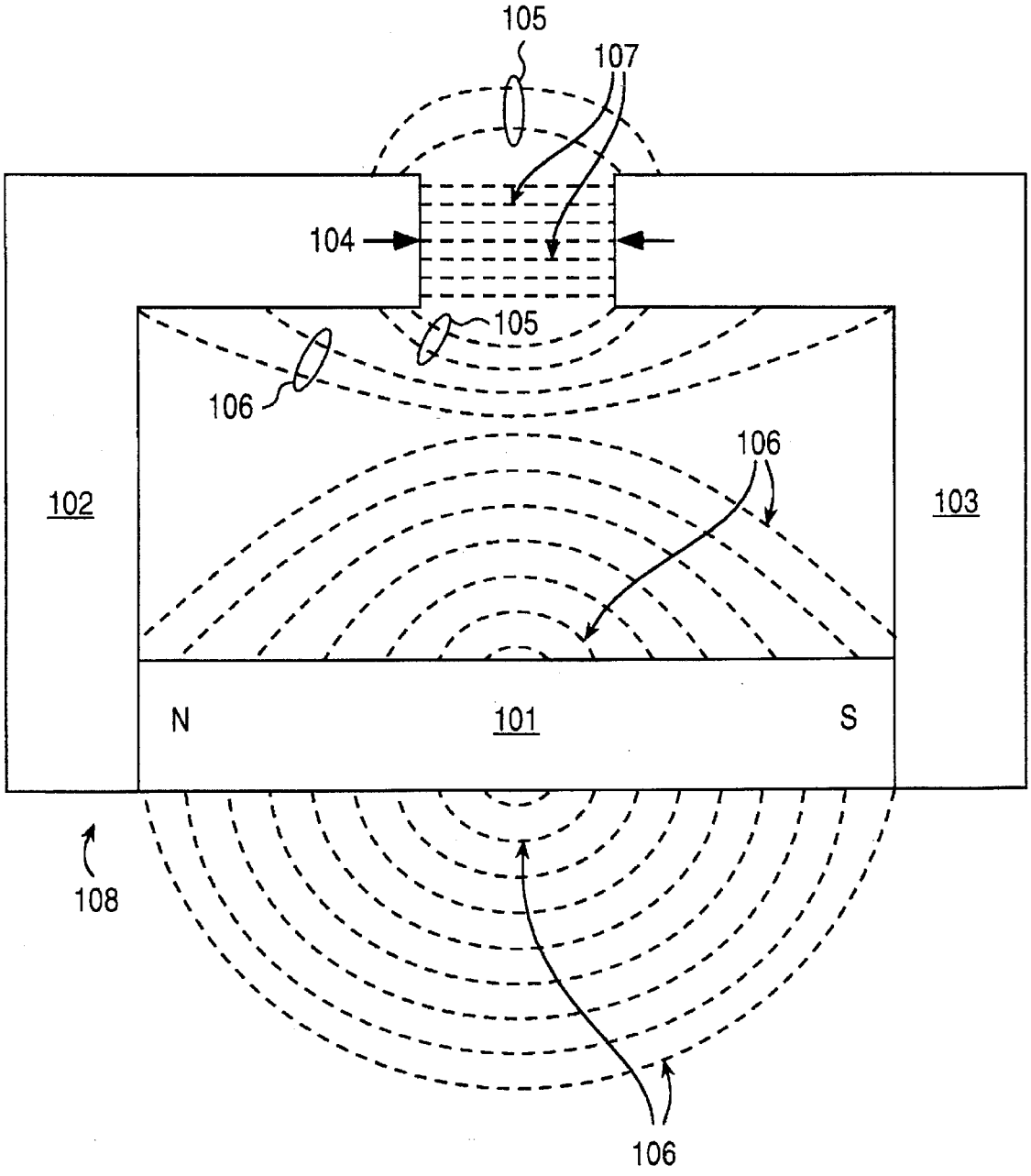
FIG. 1 (Prior Art)
FIG. 1 is a diagram of a prior art dipole permanent magnet structure illustrating leakage and fringing flux.
Figures 1, 2A:
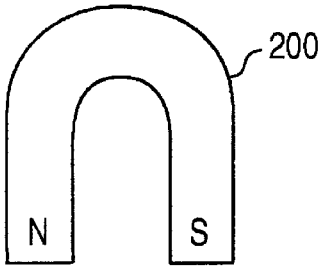
FIG. 2A-1 (Prior Art)
Figures 2, 2A:
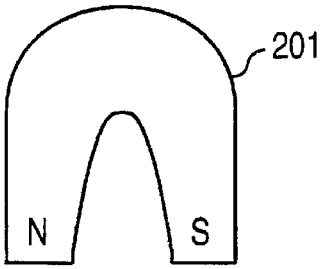
FIG. 2A-2 (Prior Art)
FIG. 2(*a*) illustrates a method for minimizing the effects of fringing flux and leakage flux in permanent magnet structures.
Figures 1, 2B:
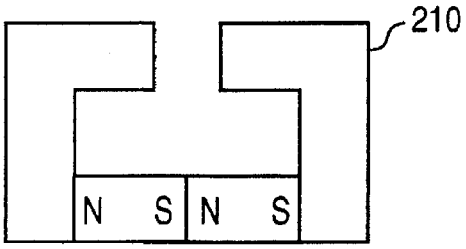
FIG. 2B-1 (Prior Art)
Figures 2, 2B:
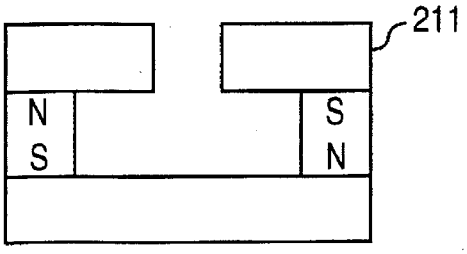
FIG. 2B-2 (Prior Art)
Figures 2, 2B, 3:
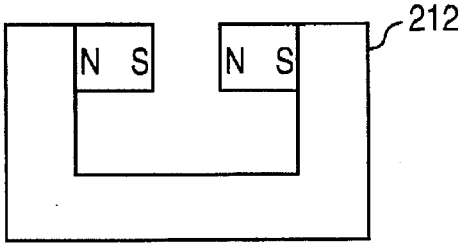
FIG. 2B-3 (Prior Art)
FIG. 3 is an illustration of an prior art H-shaped dipole permanent magnet structure.
Figures 1, 2C:
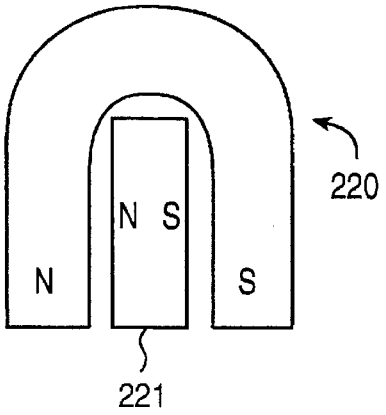
FIG. 2C-1 (Prior Art)
Figures 2, 2C:
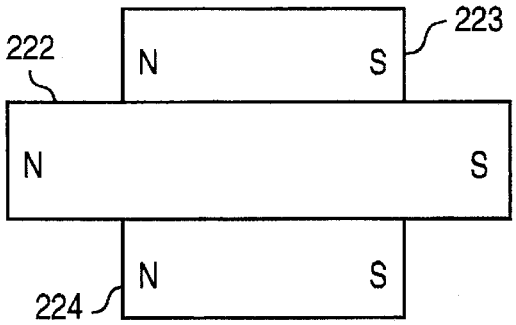
FIG. 2C-2 (Prior Art)
Figures 1, 2D:
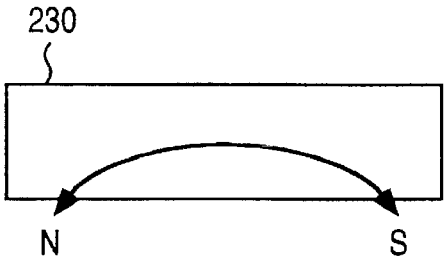
FIG. 2D-1 (Prior Art)
Figures 2, 2D:
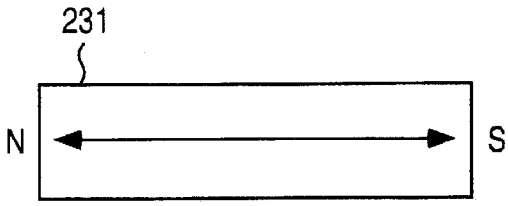
FIG. 2D-2 (Prior Art)
Figure 3:
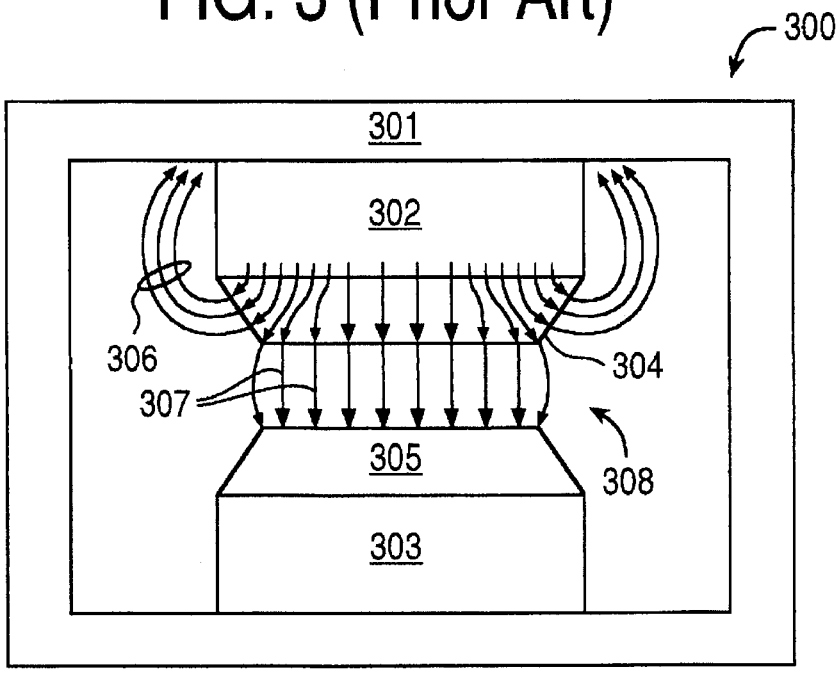
FIG. 3 (Prior Art)
Figure 4:
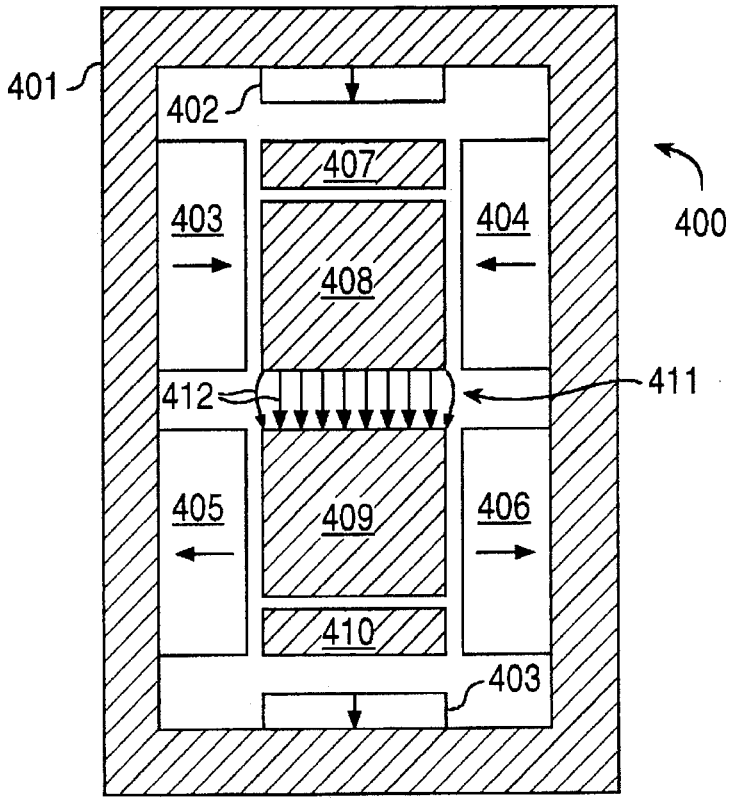
FIG. 4 (Prior Art)
FIG. 4 is an illustration of the a prior art H-shaped dipole permanent magnet structure.
Figure 5A:
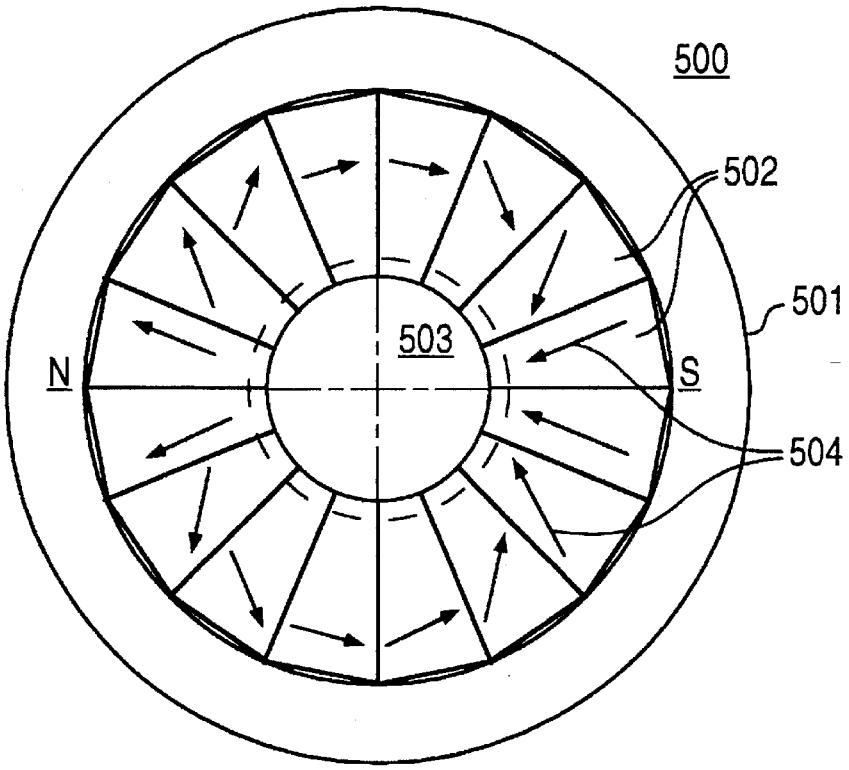
FIG. 5A (Prior Art)
FIG. 5(*a*) is a cross sectional view of yet another prior art dipole permanent magnet structure.
Figure 5B:
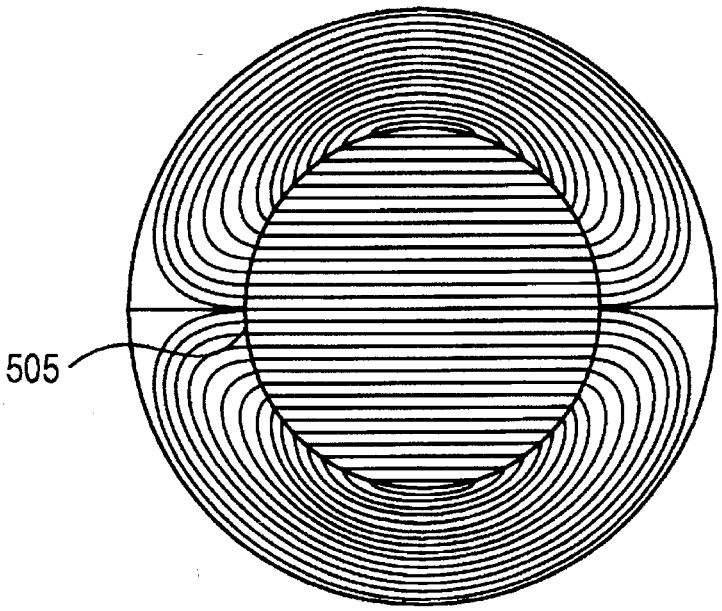
FIG. 5B (Prior Art)

The maximum flux density capable of being produced in the air gap of a prior art dipole permanent magnet structure such as that found in FIG. 5(*a*) is limited by the intrinsic coercivity of the permanent magnet material used. Although magnet materials exist that have an intrinsic coercivity ($H_{ci}$) of approximately 2.4 million Ampere-turns/meter (30,000 Oersteds), it is at a substantial reduction in residual flux density. As a result, a magnet material capable of achieving an external magnetic field having a flux density of 2.2 Tesla (22,000 Gauss) in the prior art structure of FIG. 5(*a*) would have a residual flux density of only 1.21 Tesla (12,100 Gauss).

Figure 6:
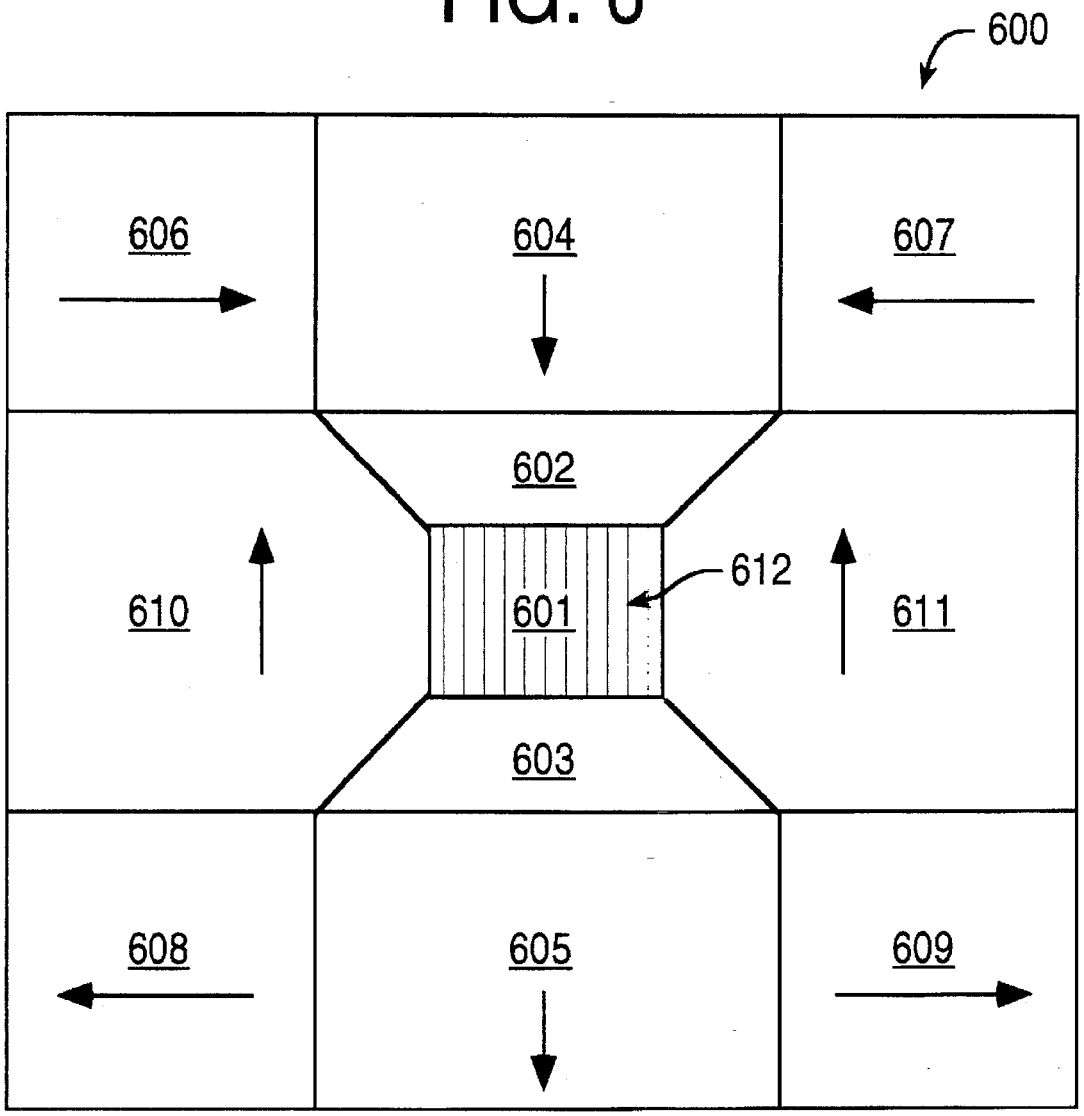
FIG. 6 is a cross sectional, two dimensional view of an embodiment of the present invention.
Figure 7A:
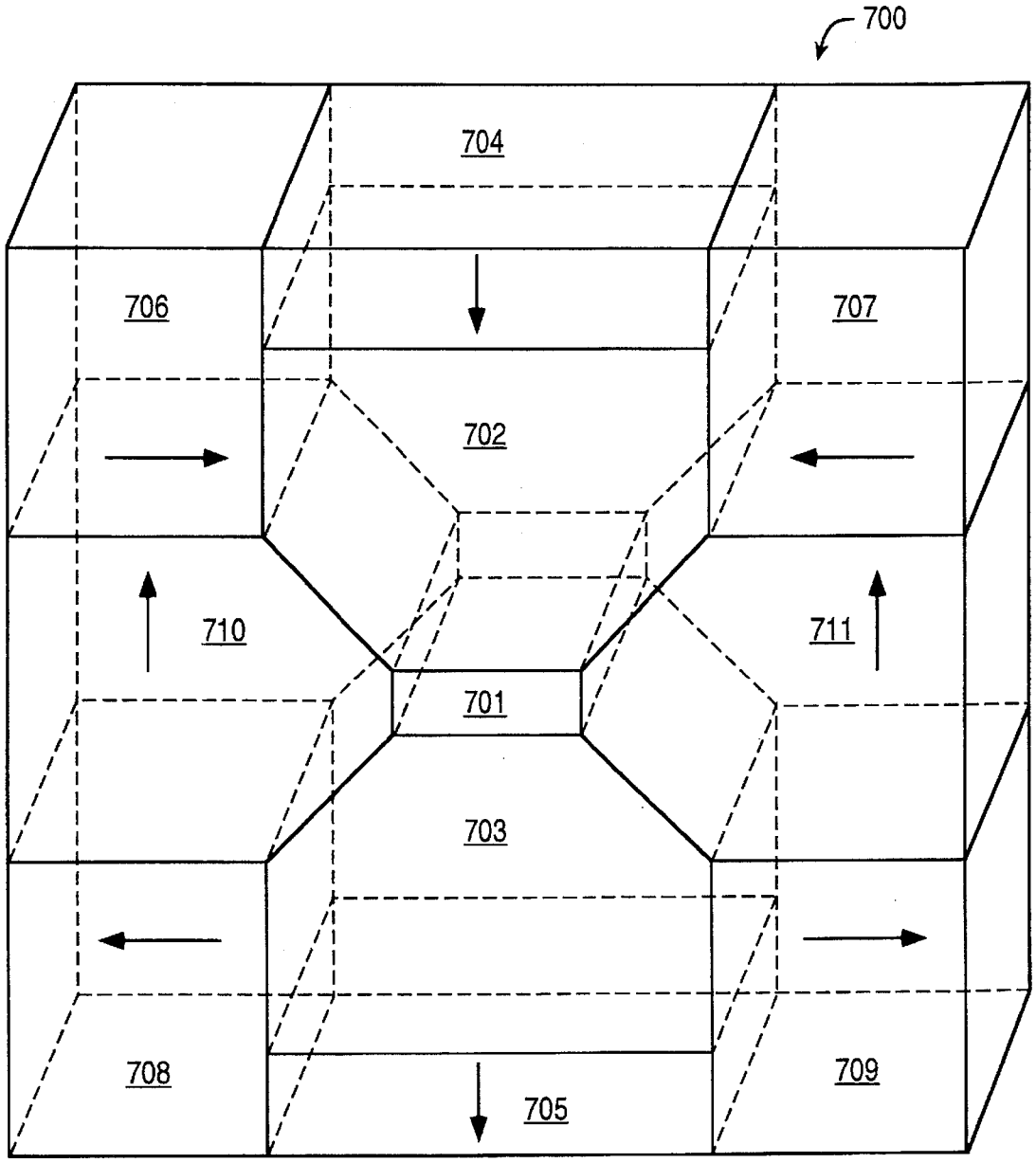
FIG. 7(*a*) is a cross sectional, three dimensional view of a further embodiment of the present invention.
Figure 7B:
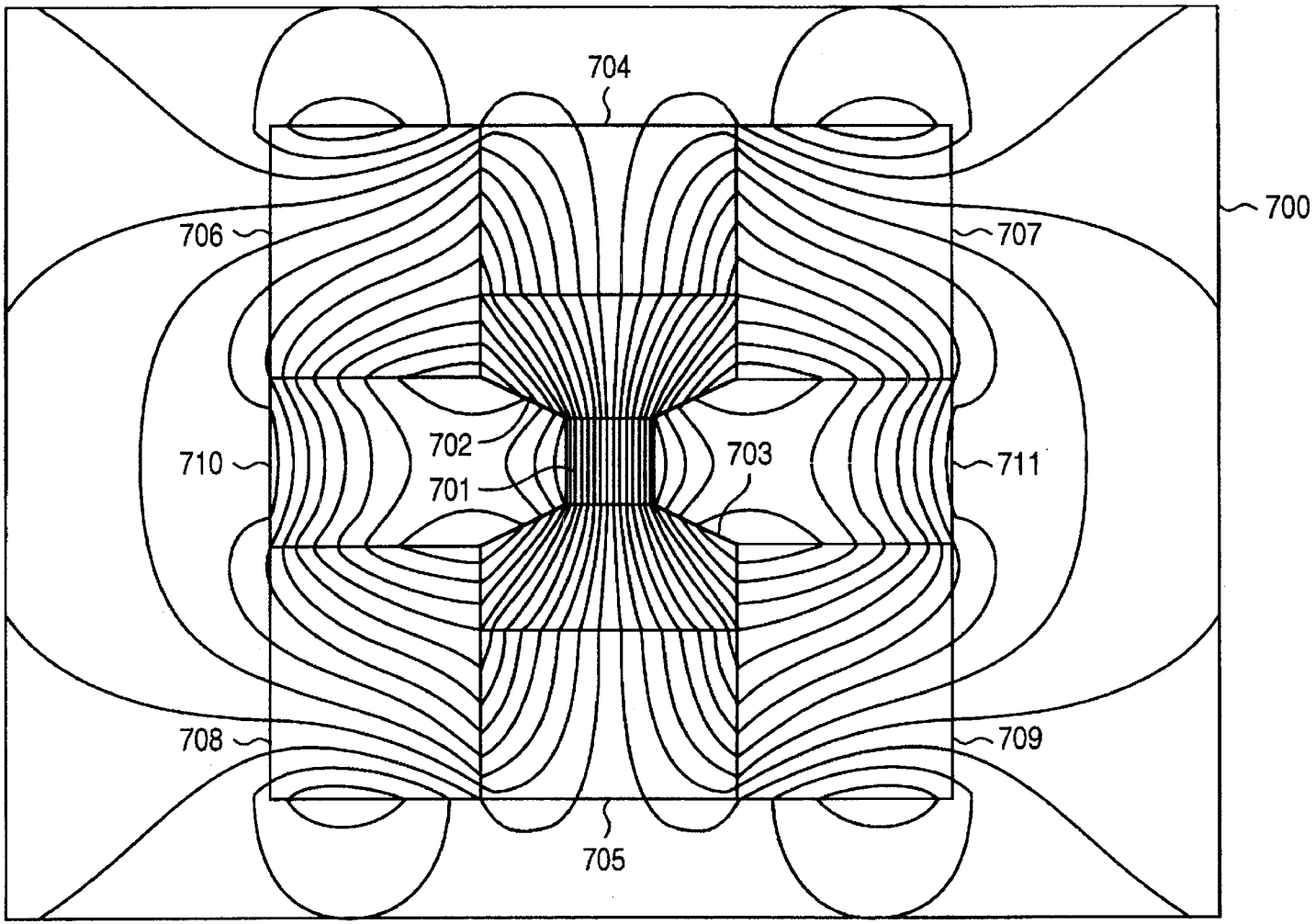

As will be demonstrated with reference to FIGS. 6, 7(*a*) and 7(*b*), the ability of an embodiment of the present invention to produce an external magnetic field having a high flux density is related to the varying alignment of the magnetic field orientations of the permanent magnets comprising the dipole permanent magnet structure to achieve a complete magnetic circuit through the magnet material and the air gap. The orientation of the magnetic field of each permanent magnet in the structure is positioned to generally align each permanent magnet's orientation in the same direction as the magnetic lines of force, i.e., the flux lines, for the magnetic circuit formed by the structure.

In another embodiment of the present invention, pole pieces (which may or may not be tapered in the direction of the air gap) are used on opposing sides of the rectangular air gap. Moreover, the pole pieces are in contact with the permanent magnets on all surfaces other than the pole tip and the two opposing surfaces perpendicular to the longitudinal axis (i.e., the axial end surfaces) to minimize leakage flux and fringing flux.

As will be seen, each permanent magnet in an embodiment of the present invention is shaped and positioned adjacent to one another in such a way as to have a positive adding superposition effect on magnetic lines of force flowing from the north pole to the south pole of the dipole structure. If a surface of a permanent magnet is not in contact with the surface of an adjacent permanent magnet, then leakage flux will result, causing a reduction of the magnetic field intensity in the air gap of the structure similar to but on a larger scale than the reduction that occurs as a result of glue placed between the surfaces of the permanent magnets during the assembly process.

The essential elements as discussed above are primarily responsible for producing an external magnetic field in the air gap in which the flux density of the field is limited only by the saturation flux density of the pole pieces in an embodiment of the present invention. Thus, unlike the prior art dipole permanent magnet structures discussed above, the present invention is not limited by the intrinsic coercivity ($H_{ci}$) of the magnet material used in the structure. The permanent magnet structure can, therefore, make use of a magnet material with a very high residual flux density without concern for the intrinsic coercivity of the magnet material. As a direct result, much less magnet volume is required to achieve a flux density in a square or rectangular air gap of approximately 2.2 to 2.4 Tesla (22,000 to 24,000 Gauss) than a prior art dipole permanent magnet structure such as that illustrated in FIG. 5(*a*).

The permanent magnet structure 500 illustrated with reference to FIG. 5(*a*) forms a ring geometry with concentric inside and outside diameters in which the magnetization vector continuously rotates from pole to pole. In practice this geometry is approximated by an assembly of trapezoids 502 cut from generally rectangular or square blocks of magnet material. The blocks, before being cut, have a magnetic orientation straight through the block as induced during manufacturing or during the magnetization process for isotropic materials. With planning, the resulting trapezoids will have a magnetic orientation such that the magnetic vector components of each trapezoid will, by superposition, add to create the desired gap flux density 505 (FIG. 5(*b*)) in the round aperture or cylindrical air gap 503.

When a square or rectangular gap is required for a given application involving a permanent magnet structure, the inner diameter of the structure of FIG. 5(*a*) must circumscribe the square or rectangular aperture. To generate a magnetic field in the air gap having a flux density of 2 Tesla, the magnet structure of FIG. 5(*a*) needs approximately 35% more magnet material than that of the present invention as shown by the overlay of the geometries of the prior art structure 500 and a permanent magnet structure 510 embodying the present invention, as illustrated in FIG. 5(*c*). The geometry of a permanent magnet structure 515 of another embodiment of the present invention is compared to the geometry of the prior art structure 500 in yet another overlay illustrated in FIG. 5(*d*), in which structure 500 would need approximately 78% more magnet material to generate a magnetic field in the air gap having a flux density of 2 Tesla.

With reference to FIG. 6, an embodiment of the present invention is described. FIG. 6 provides a two-dimensional view of a cross section of a dipole permanent magnet structure as may be embodied by the present invention. An air gap 601, centered about a longitudinal axis and rectangular in shape, provides an area in which work may be performed upon an object placed in or passed through the aperture along the axis. In another embodiment, all sides of air gap 601 may be equilateral, forming a square. Air gap 601 is bounded on opposing sides by permeable pole pieces 602 and 603 comprised of, for example, low carbon steel, 2V-Permendur, or Hiperco 50. Whatever the composition of the permeable material, the material has a saturation flux density greater than that of the magnet material comprising the permanent magnets. The pole pieces are tapered on two sides toward the gap, so that the pole pieces are wider at their base (the surface furthest from the gap) than at their tip (the surface facing the gap). Through pole pieces 602 and 603 passes a magnetic field whose flux lines 612 are in a direction perpendicular to the longitudinal axis.

Coupled to the base of each pole piece 602 and 603 is a permanent magnet (PM) 604 and 605, respectively. Permanent magnets 604 and 605, as well as all other permanent magnets in an embodiment of the present invention, are comprised of rare earth magnet material, for example, Samarium Cobalt or Neodymium Iron Boron. Such rare earth magnet materials have a very large intrinsic moment per unit volume, i.e., a high saturation magnetization. Moreover, they exhibit an extremely high resistance to demagnetization by an external field, i.e., they exhibit high coercivity. Thus, the magnet material has a linear magnetization curve (B/H ratio) in the second quadrant of the hysteresis loop, indicating the material has a very high residual flux density and is able to maintain this flux density in the presence of very high demagnetizing fields, even those in excess of the remanence of the material. Permanent magnets 604 and 605 are rectangular in shape and (as indicated by the arrows thereon in FIG. 6) have magnetic fields oriented in the same direction as the magnetic field between the pole pieces.

Permanent magnets 606 and 607 are coupled adjacent to opposing surfaces of permanent magnet (PM) 604. Both magnets are also rectangular in shape and have magnetic lines of force oriented toward PM 604, at substantially right angles to the magnetic field orientation of PM 604, thereby superpositioning their magnetic fields on the magnetic field of PM 604. Likewise, permanent magnets 608 and 609 are coupled adjacent to opposing surfaces of PM 605. Both are rectangular in shape and have their magnetic fields oriented away from and at a right angle to the magnetic field of PM 605, thereby superpositioning their magnetic fields on the magnetic field of PM 605.

Permanent magnets 610 and 611 are polygon in shape. More specifically, in one embodiment of the present invention, they each form a hexagonal shape perpendicular to the longitudinal axis. PM 610 is coupled between PMs 606 and 608, while PM 611 is coupled between 607 and 609. PMs 610 and 611 are sized and shaped so their fields are superpositioned with the magnetic fields of adjacent permanent magnets 606, 608, 607 and 609. Thus, the magnetic field of PM 610 is oriented toward PM 606 and is at right angles to the magnetic fields of PM 606 and 608. Likewise, the magnetic field of PM 611 is oriented toward PM 607 and is at right angles to the magnetic fields of PM 607 and 609. By aligning the magnetic fields of each of the permanent magnets 606–611 in this manner, each PM contributes to the orientation and intensity of the magnetic field passing through pole piece 602 to pole piece 603 by adding to and completing a dipole magnetic circuit through the permanent magnet structure 600.

Additionally, PMs 610 and 611 act as blocking magnets. A surface on each of PMs 610 and 611 combine to form opposing sides of air gap 601, completing the rectangular aperture formed with the adjacent surfaces of the pole piece tips. These surfaces on PMs 610 and 611 abutting the aperture, in addition to the orientation of the magnetic fields of PMs 610 and 611 make the PMs operate as blocking magnets to force fringing flux back into the gap at the sides of the rectangular gap adjacent the pole piece tips. Moreover, PMs 610 and 611 force lines of flux at the tapered sides of pole pieces 602 and 603 to focus through the gap rather than around the gap.

FIG. 7(*a*) illustrates, for example, another embodiment of the present invention. The embodiment described with reference to FIG. 7(*a*) operates in essentially the same manner as the embodiment described with reference to FIG. 6. FIG. 7(*a*) provides a three-dimensional cross section view of an embodiment of the present invention in which pole pieces 702 and 703, unlike the pole pieces in FIG. 6, extend into the permanent magnet material such that the size of permanent magnets 704 and 705 is smaller with respect to the other permanent magnets 706–711 in the embodiment, i.e., the pole pieces are relatively larger. More importantly, the pole pieces have five surfaces adjacent permanent magnets as opposed to three surfaces in the previously discussed embodiment. For example, pole piece 702 has surfaces adjacent, or coupled, to a surface of permanent magnets 704, 706 and 707, 710 and 711. The tapered pole pieces extend into the magnet material to allow them to be driven by the magnet material on each surface in contact with the permanent magnets so that flux is collected in the pole pieces and focused on the air gap from all surfaces of the pole pieces (other than the axial end surfaces). As demonstrated in FIG. 7(*b*), this has a significant impact on reducing leakage flux, as the permanent magnets are collectively pushing and concentrating the lines of flux back toward the pole pieces and the air gap to achieve a high flux density in the air gap.

Figure 8:
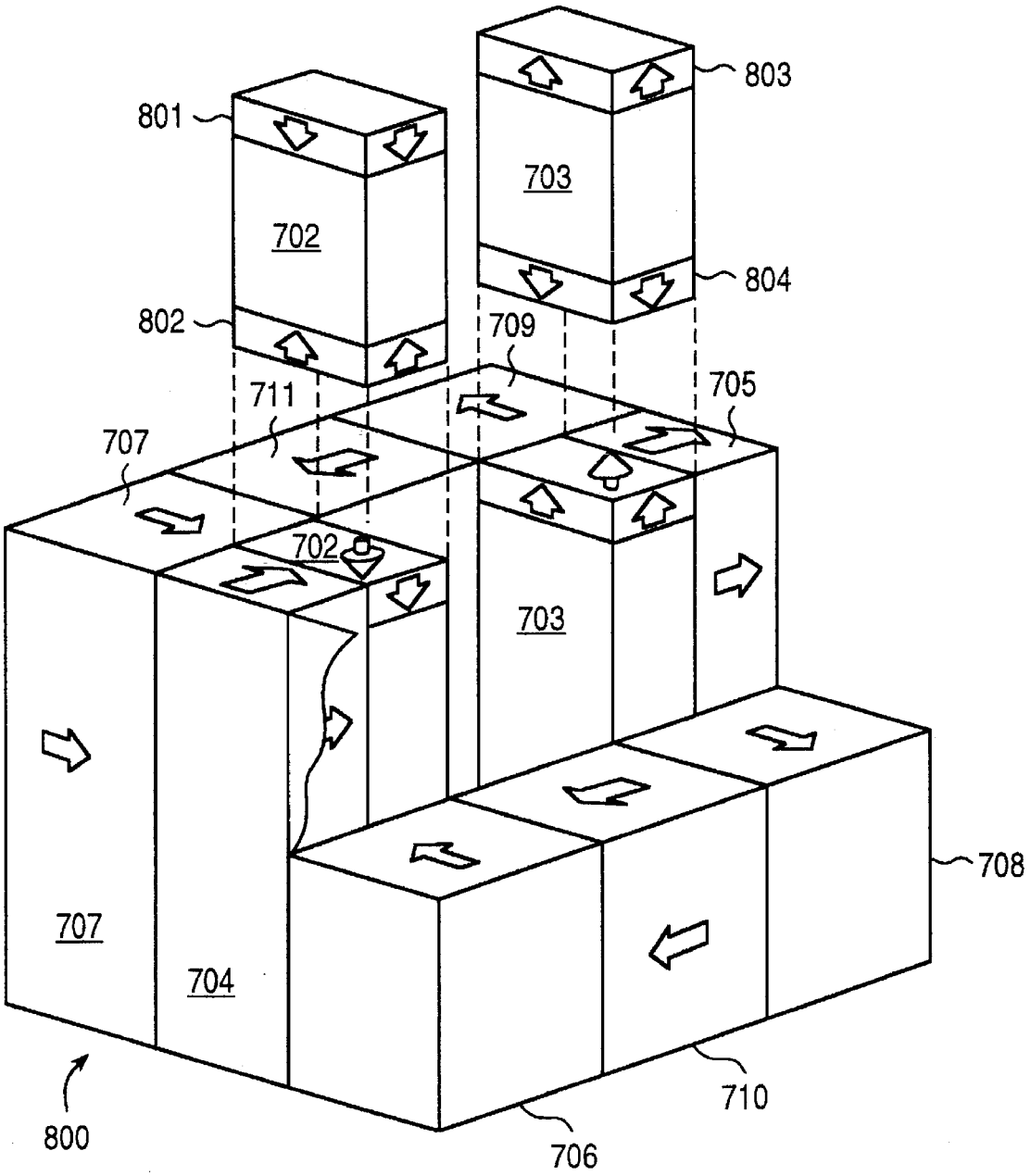
FIG. 8 is a three dimensional view of a further embodiment of the present invention.

FIG. 8 illustrates yet another embodiment of the present invention. As with FIG. 7(*a*), FIG. 8 operates in essentially the same manner as the embodiment described with reference to FIG. 6. The permanent magnet structure 800 of FIG. 8 further reduces leakage flux by capping the axial ends of the pole pieces, in this embodiment, rectangular pole pieces, with permanent magnets (which may be referred to as capping magnets because the magnets cap the pole pieces) oriented so that their fields add by superposition to the flux density in the gap while blocking leakage flux out the axial ends of the pole pieces. Thus, pole piece 702 is capped on both axial ends by magnets 801 and 802. Likewise, pole piece 703 is capped on both axial ends by magnets 803 and 804. It is appreciated that the dimensions of the capping magnets depend on the dimensions of the axial ends of the pole pieces. Thus, although in the embodiment in FIG. 8 the axial ends of the pole pieces are rectangular or square, the capping magnets may well be a polygon of a different shape and dimension.

Figure 9:
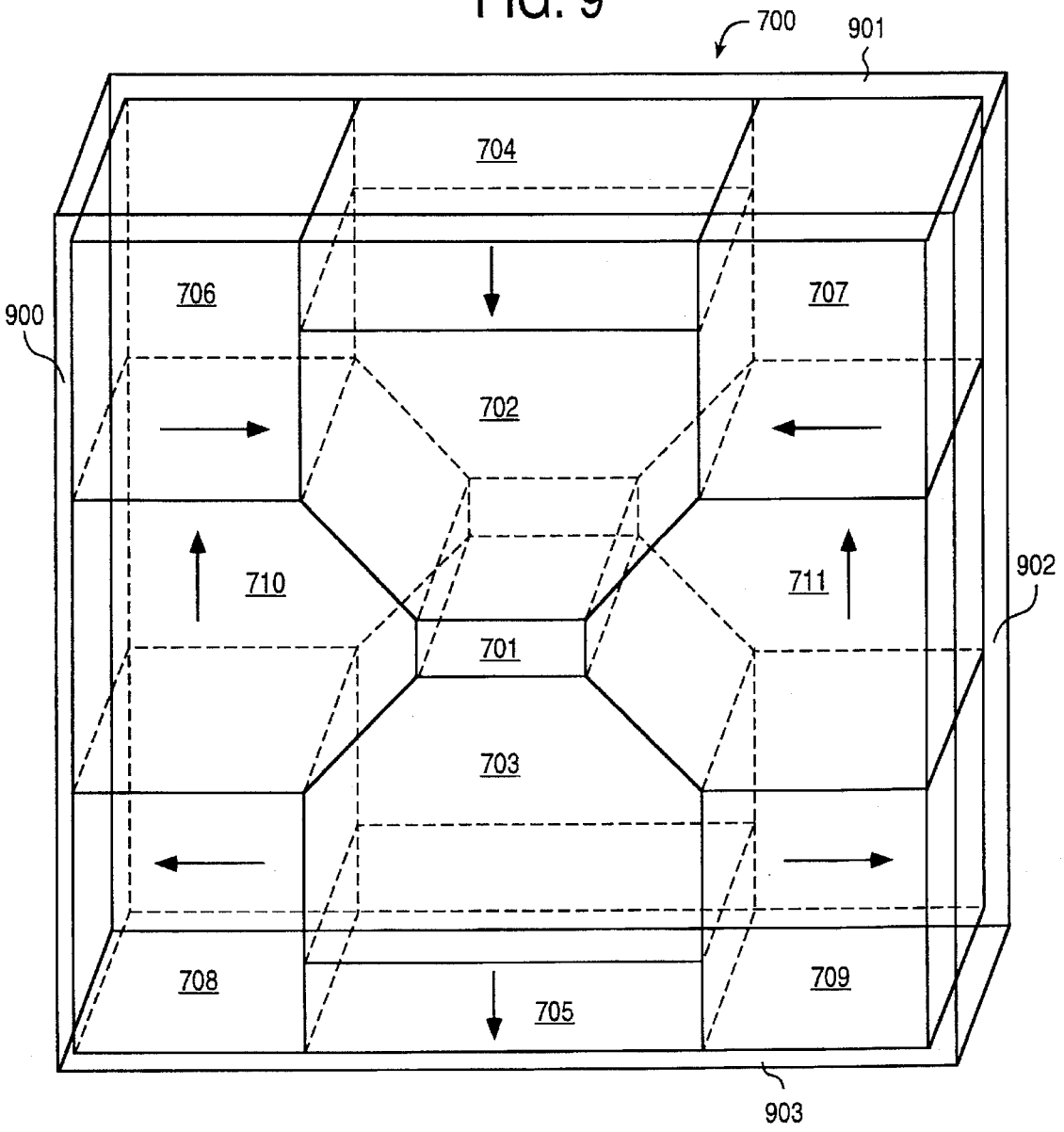
FIG. 9 illustrates the enclosure of an embodiment of the present invention in a shell of permeable magnet material.

Some flux leakage occurs where magnets with quadrature magnetic field orientations are joined, i.e., where the magnetic fields of adjacent permanent magnets are oriented at right angles to one another, as illustrated in, for example, FIG. 9. By enclosing the outside dimension of the permanent magnet structure 900 with a shell of permeable material, for example, steel, leakage flux is further reduced, thereby increasing the flux density in the rectangular or square air gap 701. In one embodiment of the present invention, increases in air gap flux density of approximately 5% have been demonstrated. With reference to FIG. 9, the permeable shell is comprised of slabs 900, 901, 902 and 903 of permeable material, each of which are affixed to the four outside surfaces parallel to the longitudinal axis of permanent magnet structure 900.

The permeable shell is useful as well in assembling the permanent magnets comprising structure 900 in that bringing the permanent magnets together while in contact with the shell causes some of the magnetic flux from the permanent magnets to be shunted by the permeable shell. The force of attraction to the shell material reduces the forces of repulsion between the permanent magnets where permanent magnets of like polarities are adjacent to each other.

There are, of course, many possible alternatives to the described embodiments which are within the understanding of one of ordinary skill in the relevant art. The present invention is intended to be limited, therefore, only by the claims presented below.

Thus, what has been described is a dipole permanent magnet structure for generating an intense external magnetic field in the gap of the permanent magnet structure.

What is claimed is:

1. A dipole permanent magnet structure having a rectangular gap centered about a longitudinal axis, wherein a pair of permeable pole pieces form two opposing sides of said rectangular gap, said structure comprising:

at least eight permanent magnets coupled about the longitudinal axis, wherein two of said permanent magnets each form a side normal to said two opposing sides of said rectangular gap to form said rectangular gap;

said permanent magnets each having a magnetic field, said magnetic field having an orientation; and, said orientation of said magnetic field of each of said permanent magnets aligned to form a magnetic circuit that generates a magnetic field in said rectangular gap having a flux density greater than the residual flux density of said magnetic field of each of said permanent magnets.

2. The dipole permanent magnet structure of claim 1 wherein said rectangular gap has equilateral sides.

3. The dipole permanent magnet structure of claim 1 wherein said rectangular gap is square.

4. The dipole permanent magnet structure of claim 1 wherein each of said eight permanent magnets is a rectangular block of magnet material.

5. The dipole permanent magnet structure of claim 4 wherein each of said eight permanent magnets is made of highly coercive magnet material.

6. The dipole permanent magnet structure of claim 4 wherein each of said eight permanent magnets has a high saturation magnetization level.

7. The dipole permanent magnet structure of claim 6 wherein each of said eight permanent magnets is comprised of rare earth permanent magnet material.

8. The dipole permanent magnet structure of claim 7 wherein said rare earth permanent magnet material is Samarium Cobalt.

9. The dipole permanent magnet structure of claim 7 wherein said rare earth permanent magnet material is Neodymium Iron Boron.

10. The dipole permanent magnet structure of claim 1 further comprising a permeable shell coupled to said permanent magnets parallel to said longitudinal axis to reduce leakage flux.

11. A dipole permanent magnet structure having a rectangular gap about a longitudinal axis, said structure comprising:

a first pole piece and a second pole piece forming opposing sides of said rectangular gap to permit a magnetic field having a flux density in said rectangular gap;

a first permanent magnet coupled to said first pole piece, having a magnetic field oriented toward said first pole piece;

a second permanent magnet coupled to said second pole piece, having a magnetic field oriented away from said second pole piece;

said first permanent magnet and said second permanent magnet forming said magnetic field in said rectangular gap;

a plurality of permanent magnets coupling said first permanent magnet and said second permanent magnet to form a magnetic circuit through said rectangular gap; and said plurality of permanent magnets each having a magnetic field oriented to intensify said magnetic field in said rectangular gap, said magnetic field in said first permanent magnet, said second permanent magnet and each of said plurality of permanent magnets having a residual flux density, wherein said flux density in said rectangular gap is greater than said residual flux density.

12. The dipole permanent magnet structure of claim 11 wherein said rectangular gap forms an equilateral rectangle.

13. The dipole permanent magnet structure of claim 11 wherein said first permanent magnet, said second permanent magnet, and each of said plurality of permanent magnets is a rectangular block of magnet material.

14. The dipole permanent magnet structure of claim 13 wherein said first permanent magnet, said second permanent magnet, and each of said plurality of permanent magnets is made of highly coercive magnet material.

15. The dipole permanent magnet structure of claim 14 wherein said first permanent magnet, said second permanent magnet, and each of said plurality of permanent magnets has a high saturation magnetization level.

16. The dipole permanent magnet structure of claim 15 wherein said highly coercive magnet material is rare earth magnet material.

17. The dipole permanent magnet structure of claim 16 wherein said rare earth permanent magnet material is Samarium Cobalt.

18. The dipole permanent magnet structure of claim 16 wherein said rare earth permanent magnet material is Neodymium Iron Boron.

19. The dipole permanent magnet structure of claim 11 wherein said first pole piece and second pole piece are made of permeable magnet material.

20. The dipole permanent magnet structure of claim 19 wherein said permeable magnet material is 2V Permendur.

21. The dipole permanent magnet structure of claim 19 wherein said permeable material is Hiperco 50.

22. The dipole permanent magnet structure of claim 19 wherein said permeable material is low carbon steel.

23. The dipole permanent magnet structure of claim 11 wherein said first pole piece and second pole piece are tapered to reduce fringing flux between said first pole piece and said second pole piece.

24. The dipole permanent magnet structure of claim 11 wherein said plurality of permanent magnets each having a magnetic field oriented to intensify said magnetic field in said rectangular gap increases the flux density of said magnetic field in said rectangular gap so that said flux density of said magnetic field in said rectangular gap approaches the saturation flux density of said first pole piece and said second pole piece.

25. The dipole permanent magnet structure of claim 11 further comprising a permeable shell coupled to said first permanent magnet, said second permanent magnet, and said plurality of permanent magnets, parallel to said longitudinal axis to reduce leakage flux.

26. A dipole permanent magnet structure having a rectangular gap about a longitudinal axis, comprising:

a first pole piece and a second pole piece, each having a tip and a base, each said tip forming an opposing side of said rectangular gap to permit establishing a magnetic field between said each said tip;

a first rectangular permanent magnet (hereafter referred to as PM), coupled to said base of said first pole piece, said first rectangular PM having a magnetic field oriented toward said first pole piece and perpendicular to said longitudinal axis;

a second rectangular PM coupled to said base of said second pole piece, said second rectangular PM having a magnetic field oriented away from said second pole piece and perpendicular to said longitudinal axis, said first rectangular PM and said second rectangular PM thereby establishing a magnetic field between each said tip;

a first pair of rectangular PMs, each coupled to an opposing side of said first rectangular PM, each having a magnetic field oriented toward said first rectangular PM;

a second pair of rectangular PMs, each coupled to an opposing side of said second rectangular PM, each having a magnetic field oriented away from said second rectangular PM; and, a pair of blocking magnets, each forming an opposing side of said rectangular gap adjacent to each said tip to prevent fringing, each said blocking magnet coupling one of said first pair of rectangular PMs to one of said second pair of rectangular PMs, each said blocking magnet having a magnetic field oriented toward said one of said first pair of rectangular PMs to form a magnetic circuit between said first pole piece and said second pole piece.

27. The dipole permanent magnet structure of claim 26 wherein said first pole piece and said second pole piece are tapered from said base to said tip to prevent fringing, thereby increasing the flux density of said magnetic field between each said tip.

28. The dipole permanent magnet structure of claim 27 wherein each of said blocking magnets is tapered to be contiguous with said first pole piece and said second pole piece between said base and said tip of said first pole piece and said second pole piece.

29. The dipole permanent magnet structure of claim 27 wherein said first pole piece and said second pole piece are made of permeable material.

30. The dipole permanent magnet structure of claim 29 wherein said permeable material is 2V Permendur.

31. The dipole permanent magnet structure of claim 29 wherein said permeable material is Hiperco 50.

32. The dipole permanent magnet structure of claim 29 wherein said permeable material is low carbon steel.

33. The dipole permanent magnet structure of claim 26 wherein said first rectangular PM, said second rectangular PM, said first pair of rectangular PMs, said second pair of rectangular PMs, and said blocking magnets are made of highly coercive magnet material.

34. The dipole permanent magnet structure of claim 26 wherein said first rectangular PM, said second rectangular PM, said first pair of rectangular PMs, said second pair of rectangular PMs, and said blocking magnets have a high saturation magnetization level.

35. The dipole permanent magnet structure of claim 33 wherein said highly coercive material is rare earth magnet material.

36. The dipole permanent magnet structure of claim 35 wherein said rare earth magnet material is comprised of Samarium Cobalt.

37. The dipole permanent magnet structure of claim 35 wherein said rare earth magnet material is comprised of Neodymium Iron Boron.

38. The dipole permanent magnet structure of claim 26 further comprising a permeable shell coupled to said first rectangular PM, said second rectangular PM, said first pair of rectangular PMs, said second pair of rectangular PMs, and said pair of blocking magnets, parallel to said longitudinal axis to reduce leakage flux.

39. A dipole permanent magnet structure having a rectangular gap about a longitudinal axis, comprising:

a first pole piece and a second pole piece, each having 1) a tip forming an opposing side of said rectangular gap, 2) a base, and 3) and two sides adjacent said tip and said base, partially tapered so that said base is wider than said tip;

a first rectangular permanent magnet coupled to said base of said first pole piece, having a magnetic field oriented in a direction toward said first pole piece;

a second rectangular permanent magnet coupled to said base of said second pole piece, having a magnetic field oriented in a direction away from said second pole piece;

a first pair of rectangular permanent magnets each coupled on opposing sides of said first pole piece and said first rectangular permanent magnet, each having a magnetic field oriented in a direction toward said first pole piece so that lines of flux enter said first pole piece from said first rectangular permanent magnet and said first pair of rectangular permanent magnets;

a second pair of rectangular permanent magnets each coupled on opposing sides of said second pole piece and said second rectangular permanent magnet, each having a magnetic field oriented in a direction away from said second pole piece so that lines of flux flow from said second pole piece to said second rectangular permanent magnet and said second pair of rectangular permanent magnets; and, a pair of blocking magnets, each forming an opposing side of said rectangular gap adjacent to each said tip, each said blocking magnet coupling one of said first pair of rectangular permanent magnets to one of said second pair of rectangular permanent magnets, each said blocking magnet having a magnetic field oriented toward said one of said first pair of rectangular permanent magnets to form a magnetic circuit between said first pole piece and said second pole piece.

40. The dipole permanent magnet structure of claim 39 further comprising a permeable shell coupled to said first rectangular permanent magnet, said second rectangular permanent magnet, said first pair of rectangular permanent magnets, said second pair of rectangular permanent magnets, and said pair of blocking magnets, parallel to said longitudinal axis to reduce leakage flux.

* * * * *